United States Patent [19]

Johnston

[11] Patent Number: 4,984,724

[45] Date of Patent: Jan. 15, 1991

[54] FLASHLIGHT CARRYING STRAP

[76] Inventor: Rex L. Johnston, 12715 Mapleview Street, #23, Lakeside, Calif. 92040

[21] Appl. No.: 428,325

[22] Filed: Oct. 27, 1989

[51] Int. Cl.[5] ..... A45F 3/14

[52] U.S. Cl. ..... 224/257; 224/901; 224/258; 224/205; 362/108

[58] Field of Search ..... 224/207, 205, 206, 257, 224/258, 901, 915, 917, 922, 251; 362/108, 103, 190, 191, 457

[56] References Cited

U.S. PATENT DOCUMENTS

| | | | |
|---|---|---|---|
| 1,717,386 | 6/1929 | Kaplan | 362/108 |
| 2,506,685 | 5/1950 | Sadlwki et al. | 362/108 |
| 2,530,695 | 11/1950 | Helmert | 224/917 |
| 3,960,302 | 6/1976 | Mazzoni, Jr. | 224/901 |
| 4,096,977 | 6/1978 | Barville et al. | 224/901 |
| 4,537,341 | 8/1985 | Kelly | 224/202 |
| 4,751,923 | 6/1988 | Marino | 224/901 |
| 4,911,347 | 3/1990 | Wilhite | 224/257 |

FOREIGN PATENT DOCUMENTS

| | | | |
|---|---|---|---|
| 3128920 | 2/1983 | Fed. Rep. of Germany | 224/257 |
| 767014 | 1/1957 | United Kingdom | 224/264 |

*Primary Examiner*—Henry J. Recla
*Assistant Examiner*—Glenn T. Barrett
*Attorney, Agent, or Firm*—Baker, Maxham, Jester & Meador

[57] ABSTRACT

An adjustable shoulder carrying strap for carrying a flashlight comprises an elongated main shoulder strap for extending over a shoulder, a first flashlight case gripping strap secured at its mid portion to one end of the shoulder strap transverse thereto and having complementary hook and loop fastening means on opposite ends thereof, an end strap having a take up buckle on one end thereof and to the other end of the shoulder strap, a second flashlight case gripping strap secured to the other end of the end strap transverse thereto and having complementary hook and loop fastening strips on each end thereof for detachably securing around the body of a flashlight, and a gripping inner surface on the first and second gripping straps for gripping the outer surface of a flashlight body.

9 Claims, 1 Drawing Sheet

FLASHLIGHT CARRYING STRAP

BACKGROUND OF THE INVENTION

The present invention relates to carrying straps and and pertains particularly to a carrying strap for flashlights and the like.

A hand-held flashlight is frequently an essential tool for the safety and security of a person, particularly at night and in unlit enclosures. Flashlights are available in many sizes and forms, with the hand-held cylindrical type being the most popular type. While such flashlights are quite practical and useful, they are designed to be hand-held and leave only one hand free for other uses.

While clips for clipping a flashlight to the clothing of a person are known, they are available only for very few models of small flashlights. Clips are also capable of holding the flashlight only in a very limited number of useful positions.

It is therefore desirable that improved means be available for carrying flashlights leaving both hands free.

SUMMARY AND OBJECTS OF THE INVENTION

It is the primary object of the present invention to provide an improved carrying strap for flashlights.

In accordance with a primary aspect of the present invention, a carrying strap for a flashlight comprises a shoulder strap, with first and second flashlight case gripping straps at opposite ends of the shoulder strap for encircling and gripping the case of a flashlight at fore and aft ends thereof.

BRIEF DESCRIPTION OF THE DRAWING

The above and other objects and advantages of the present invention will become apparent from the following description when read in conjunction with the accompanying drawings wherein.

DETAILED DESCRIPTION OF A PREFERRED EMBODIMENT

Figure 1:
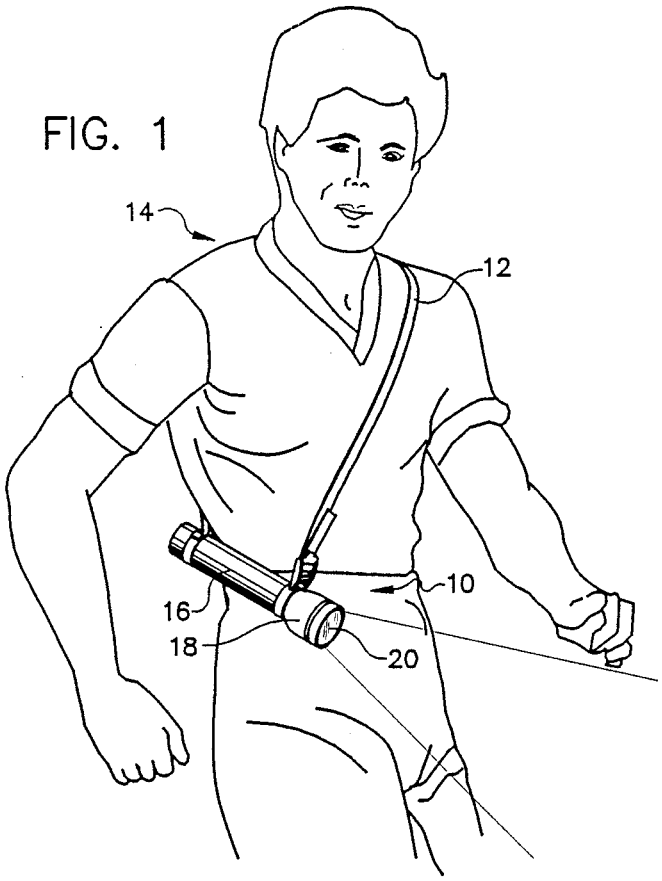
FIG. 1 is a perspective view of a preferred embodiment of the invention shown in use.
Figure 3:
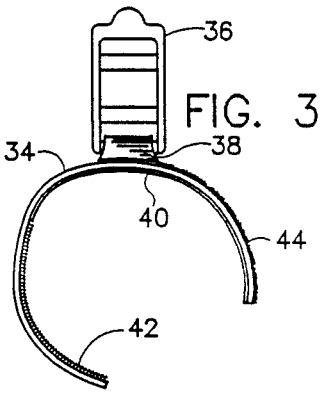
FIG. 3 is a detailed view of one of the end gripping straps.
Figure 4:
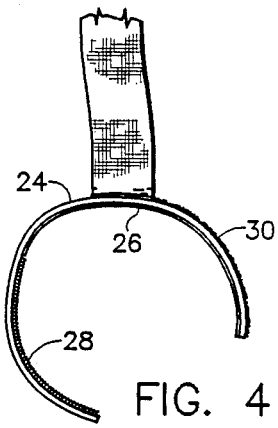
FIG. 4 is a detailed view of the other end gripping strap.

Referring to FIG. 1 of the drawing, a preferred embodiment of the invention is designated generally by the numeral 10, and is illustrated in use on the shoulder of a person, designated generally by the numeral 14. The illustrated embodiment comprises an elongated shoulder strap member 12, shown in use over the left shoulder of a person 14, with opposite ends thereof detachably connected to and supporting a traditional cylindrical tubular dry cell flashlight 16. The illustrated flashlight, and for which the invention is particularly designed, is of the elongated cylindrical body or housing type having a head 18, with a lens 20 on one end of the tubular body which contains a plurality of dry cell batteries positioned end to end. The flashlight body typically has a removable rear end cap (not shown) for access to and replacement of the batteries.

The carrying strap assembly 10, in the illustrated embodiment, is shown with the shoulder harness or strap 12 extending over the left shoulder of the individual 14 holding the flashlight 16 against the right side of the individual's body at approximately waist high or slightly above. One of the difficulties with the use of flashlights in the past has been the inability to effectively use the flashlight with both hands free. In the illustrated embodiment, the individual has both hands free to carry out any task requiring the use of light and both hands. The strap 12 may be adjusted to snug the flashlight against the side of the person to prevent its swinging and enable it to be turned with turning the body.

Figure 2:
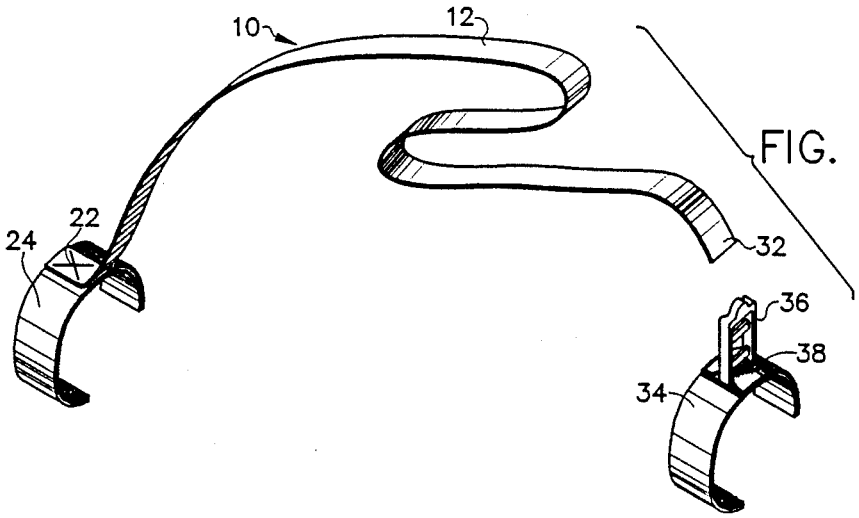
FIG. 2 is a perspective exploded view of the strap of FIG. 1.

The flashlight carrying strap or harness assembly, as best illustrated in FIG. 2, comprises an elongated shoulder strap 12, having a first end 22 which is secured such as by stitching or the like to substantially the mid portion of a first or rear flashlight case or housing gripping strap 24. The strap 24 is preferably on the order of about seven to nine inches in length and from about one-half inch to about three-quarters of an inch in width. The strap is provided with case gripping means 26 in the form of a coating or layer of rubber or like non-slid material covering approximately two-thirds or more of the interior or internal surface of the strap. This surface or gripping material provides a secure gripping of the surface of the flashlight to prevent the flashlight from slipping from the strap as it is looped about the flashlight.

The strap is securely and detachable fastened around the flashlight body by means of hook and loop fastening means 28 and 30 of the Velcro type. This hook and loop fastening means in the illustrated embodiment comprises a hook fabric 28 on the interior one end of the strap 24, and loop fabric on the outside of the opposite end of the loop or case gripping strap 24. Other forms of securing means may be utilized. However, the hook and loop type is preferred. This enables the strap or loop to quickly and conveniently adjust to the size of the particular flashlight and securely grip the flashlight body. The illustrated arrangement can fit and secure to flashlights from the small flashlights of less than one-half inch in diameter up to those of about two or more inches in diameter.

The strap 24 is secured transverse to the longitudinal axis of the shoulder strap 12, forming a T junction essentially at this point. The straps may be secured together in any suitable manner, such as sewing or the like.

The shoulder strap 12 has an opposite end 32, which is detachably and adjustably secured to a forward or second flashlight case gripping strap or loop 34, which is of substantially identical size and construction to the previously described strap. However, this strap is secured to the shoulder strap 12 at end 32 by means of a take up buckle 36, which is secured by suitable strap means 38 directly to the center of the strap 34. The end 32 of the shoulder strap 12 is then looped through the take up buckle 36, as shown in FIG. 1, to enable the end 32 to be pulled for taking up slack in the shoulder strap 12. This enables one to snug the flashlight case against the side of the carrier's body. This adjustable shoulder strap enables the flashlight to be selectively carried loosely or tight against the operator's body as desired.

The strap 34, as in the previous strap, includes a gripping surface 40 of a rubber like material, such as silicone rubber as a surface layer or as a separate thin strap sewn to the inner surface thereof for gripping the flashlight case. The strap is similarly provided with a suitable hook and loop fastening means 42 and 44 for detachably securing the case gripping strap about the body of a flashlight. The gripping surfaces 26 and 40 of the straps or loops 24 and 34 enable the straps to securely grip the outer surface of a cylindrical flashlight, and prevent the flashlight from slipping from the carrying strap assembly or harness. The straps may be made of any suitable flexible strap material, are preferably of a good grade of webbing strap. The straps are preferably on the order of from about one-half inch to about one inch in width. The straps however can be either narrower or wider if desired for certain application.

In use, the end gripping straps 24 and 34 are securely fastened around the opposite ends of a flashlight, as shown for example in FIG. 1, and the end 32 secured in the buckle 36. The flashlight strap assembly shoulder strap 12 may be slung over either shoulder, with the flashlight on either the same side of the individual or on the opposite side, as illustrated. The advantage of placing the flashlight and shoulder strap on opposite sides is the ability to snug the flashlight against the side of the user. It will also be appreciated that the flashlight can be slipped around the individual to point to one side of the individual, such as to the left side or the right side without interfering with the use of the hands. The strap can also be placed around the user's waist and snugged tight. The end of the strap 12 can be pulled to adjustably snug the flashlight against the body of the user to more securely hold it in a stabilized position.

While I have illustrated and described my invention by means of specific embodiments, it is to be understood that numerous changes and modifications may be made therein without departing from the spirit and scope of the invention as defined in the appended claims.

I claim:

1. An adjustable flashlight carrying strap for adjustably securing a flashlight against the body of a person for hands free holding of the flashlight in selected light directing orientations, comprising:

an elongated main shoulder strap for extending over a shoulder;

a first flashlight case gripping strap having elastomeric gripping means on an inner surface thereof for engaging and gripping an outer surface of a flashlight body and non-pivotally secured at a mid portion to one end of said shoulder strap, and having hook and loop fastening means on opposite ends thereof;

a second flashlight case gripping strap having elastomeric gripping means on an inner surface thereof for engaging and gripping an outer surface of a flashlight body and non-pivotally secured to the other end of said end strap transverse thereto and having complementary hook and loop fastening means on each end thereof for detachably securing around the body of a flashlight; and a take up buckle at one end of said shoulder strap between the said one end and one of said first and second gripping straps for selectively adjusting the length of the said shoulder strap and for securing a flashlight therein against a side of a person in selected light directing orientations.

2. A flashlight carrying strap according to claim 1 wherein:

said gripping means comprises a coating of rubber.

3. A flashlight carrying strap according to claim 1 wherein:

said gripping means comprises a coating of silicone rubber.

4. A flashlight carrying strap according to claim 1 wherein:

said shoulder strap has a length of on the order of about thirty inches in length and said case gripping straps have a length of about seven inches.

5. A combination of an elongated flashlight and an elongated flexible flashlight carrying strap for adjustably securing said flashlight against the body of a person for hands free holding of the flashlight in selected light directing orientations, comprising:

a flashlight having an elongated cylindrical body having an outer cylindrical surface and an illuminating head at one axial end thereof;

an elongated flexible shoulder strap for extending over a shoulder a person and having opposite ends;

a first flashlight case gripping strap having gripping means on an inner surface thereof for engaging and gripping an outer surface of said flashlight body and non-detachably and non-pivotally secured at a mid portion thereof to one end of said shoulder strap transverse thereto and having complementary hook and loop fastening means on opposite ends thereof;

an end strap having a take up buckle on one end thereof and adjustably secured by said take up buckle to the other end of said shoulder strap;

a second flashlight case gripping strap having gripping means on an inner surface thereof for engaging and gripping said outer surface of said flashlight body and non-detachably and non-pivotally secured to the other end of said end strap transverse thereto and having complementary hook and loop fastening means on each end thereof for detachably securing around the body of said flashlight; and said take up buckle at said one end of said shoulder strap between the said one end and said second gripping strap providing for selectively adjusting the length of the said shoulder strap and for securing said flashlight in selected light orienting positions against a side of a person.

6. A combination according to claim 5 wherein:

said gripping means comprises a coating of rubber.

7. A combination according to claim 5 wherein:

said gripping means comprises a coating of silicone rubber.

8. A combination according to claim 5 wherein:

said shoulder strap has a length of on the order of about thirty inches in length and said case gripping straps have a length of about seven inches.

9. A method of hands free carrying and orientation of an elongated flashlight, said method comprising the steps of:

selecting an elongated cylindrical body having an outer cylindrical surface and an illuminating head at one axial end thereof;

selecting a carrying harness having an elongated flexible main shoulder strap for extending over a shoulder and having opposite ends, a first flashlight case gripping strap having gripping means on an inner surface thereof for engaging and gripping an outer surface of said flashlight body and non-detachably and non-pivotally secured at a mid portion thereof to one end of said shoulder strap transverse thereto and having complementary hook and loop fastening means on opposite ends thereof, an end strap having a take up buckle on one end thereof and adjustably secured by said take up buckle to the other end of said shoulder strap, a second flashlight case gripping strap having gripping means on an inner surface thereof for engaging and gripping said outer surface of said flashlight body and non-detachably and non-pivotally secured to the other end of said end strap transverse thereto and having complementary hook and loop fastening means on each end thereof for detachably securing around the body of a flashlight; and said take up buckle at said one end of said shoulder strap between the said one end and said second gripping strap providing for selectively adjusting the length of the said shoulder strap and for securing said flashlight in selected light orienting positions against a side of a person.

* * * * *